US010373742B2

(12) United States Patent
Shimizu et al.

(10) Patent No.: US 10,373,742 B2
(45) Date of Patent: Aug. 6, 2019

(54) WIRING MODULE PRODUCTION PLANT

(71) Applicant: SUMITOMO WIRING SYSTEMS, LTD., Mie (JP)

(72) Inventors: Toshio Shimizu, Mie (JP); Takayuki Sato, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 180 days.

(21) Appl. No.: 15/664,314

(22) Filed: Jul. 31, 2017

(65) Prior Publication Data

US 2018/0040395 A1 Feb. 8, 2018

(30) Foreign Application Priority Data

Aug. 5, 2016 (JP) ..... 2016-154267

(51) Int. Cl.

| | |
|---|---|
| ***B23P 19/00*** | (2006.01) |
| ***H01R 43/00*** | (2006.01) |
| ***H01B 13/012*** | (2006.01) |
| ***B25H 1/14*** | (2006.01) |

(52) U.S. Cl.

CPC ..... *H01B 13/01236* (2013.01); *B25H 1/14* (2013.01); *H01B 13/01218* (2013.01)

(58) Field of Classification Search

CPC ..... B25H 1/14; H01B 13/01218; H01B 13/01236

See application file for complete search history.

(56) References Cited

U.S. PATENT DOCUMENTS

| | | | | |
|---|---|---|---|---|
| 4,862,927 A * | 9/1989 | Dorman | ..... | H05K 13/06 140/92.1 |
| 4,955,927 A * | 9/1990 | Aiello | ..... | H01R 43/01 29/213.1 |
| 5,127,159 A * | 7/1992 | Kudo | ..... | H01R 43/20 29/564.4 |
| 6,141,867 A * | 11/2000 | Fukada | ..... | H01R 43/20 29/33 M |

FOREIGN PATENT DOCUMENTS

| | | |
|---|---|---|
| JP | 2003-031053 | 1/2003 |

* cited by examiner

*Primary Examiner* — Paul D Kim

(74) *Attorney, Agent, or Firm* — Greenblum & Bernstein, P.L.C.

(57) ABSTRACT

A wiring module production plant includes a rotatable support supported so as to be capable of rotating and having N stages (where N is an integer equal to or greater than two) on which an object (such as a base wiring module and a bracket) involved in production of the wiring module can be arranged, the stages being provided corresponding to each of N positions having N-fold rotational symmetry. N stations are provided so as to respectively correspond to each of the N positions having N-fold rotational symmetry centered around a rotation axis of the rotatable support. The N stations include a manual work station which allows manual work to be performed on the object, and a mechanical work station which allows mechanical work to be performed on the object.

6 Claims, 14 Drawing Sheets

WIRING MODULE PRODUCTION PLANT

CROSS-REFERENCE TO RELATED APPLICATIONS

The present application claims priority under 35 U.S.C. § 119 of Japanese Application No. 2016-154267, filed on Aug. 5, 2016, the disclosure of which is expressly incorporated by reference herein in its entirety.

BACKGROUND OF THE INVENTION

1. Field of the Invention

The present invention relates to a technology to produce a wiring module.

2. Description of Related Art

Japanese Patent Laid-open Publication No. 2003-031053 discloses a work platform device that includes a base table installed so as to be capable of rotating; a rotation drive source rotating the base table in one direction at a predetermined speed; a work stand mounted on the base table along a periphery thereof; and a controller controlling each of the base table and the work stand based on a defined work process. The controller manages a work situation on the work stand in real time and controls the base table and work stand in accordance with the work situation.

In recent years, mechanization of wire harness assembly has advanced. Therefore, there is a need for a production plant capable of skillfully combining work performed manually and mechanical work to enable efficient manufacture of a wiring module.

SUMMARY OF THE INVENTION

Given this, the present invention is configured to combine work performed manually with mechanical work and to be capable of efficiently manufacturing a wiring module.

In order to resolve the above-noted issue, one aspect of the present invention is a wiring module production plant producing a wiring module, the production plant including a rotatable support supported so as to be capable of rotating and having N stages (where N is an integer equal to or greater than two) on which an object involved in production of the wiring module can be arranged, the stages being provided corresponding to each of N positions having N-fold rotational symmetry. N stations are provided so as to respectively correspond to each of the N positions having N-fold rotational symmetry centered around a rotation axis of the rotatable support. The N stations include a manual work station which allows manual work to be performed on the object, and a mechanical work station which allows mechanical work to be performed on the object.

In another aspect of the present invention, the manual work station is a station that is open to an exterior so as to allow work from outside the rotatable support on the stage that is deployed at a position corresponding to the manual work station.

In another aspect of the present invention, the mechanical work station is a station provided with processing equipment that is capable of performing processing work on the object arranged on the stage that is deployed at a position corresponding to the mechanical work station.

In another aspect of the present invention, the wiring module production plant includes a rotation regulator capable of regulating rotation of the rotatable support; a manual work end status obtainer capable of ascertaining whether manual work at the manual work station has ended; a mechanical work end status obtainer capable of ascertaining whether mechanical work at the mechanical work station has ended; and a controller controlling the rotation regulator such that, when a determination is made, based on an output result of the manual work end status obtainer and the mechanical work end status obtainer, that work at the manual work station and the mechanical work station has ended, rotation of the rotatable support is enabled.

In another aspect of the present invention, the rotation regulator is a motor rotating the rotatable support, and the controller controls drive of the motor such that, when a determination is made that work at the manual work station and the mechanical work station has ended, the rotatable support is rotated.

In another aspect of the present invention, the manual work end status obtainer is configured to include a human sensor detecting whether a worker is present in a work area of the manual work station.

According to the present invention, when the rotatable support is rotated in a state where the object is arranged on each of the N stages, the object arranged on each of the N stages can be transported to each of the N stations in sequence. Manual work is performed on the object at the manual work station, and mechanical work is performed on the object at the mechanical work station. Therefore, work performed manually is combined with mechanical work and the wiring module can be manufactured efficiently.

According to the present invention, manual work on the object at the manual work station can be readily performed by the worker positioned outside the rotatable support.

According to the present invention, processing work on the object arranged on the stage deployed at the position corresponding to the mechanical work station can be performed by the processing equipment.

According to the present invention, when the work at the manual work station and the mechanical work station is determined to have ended, the rotatable support becomes rotatable. Therefore, a situation can be prevented in which the rotatable support rotates during work.

According to the present invention, when the work at the manual work station and the mechanical work station is determined to have ended, the rotatable support can be rotated by the motor, and work is facilitated.

According to the present invention, when the worker leaves the work area, a determination that the work at the manual work station has ended is made automatically, and therefore the determination as to whether the work has ended can be made more reliably.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the forms of the present invention may be embodied in practice.

A wiring module production plant according to an embodiment is described below.

Wiring Module

Figure 1:
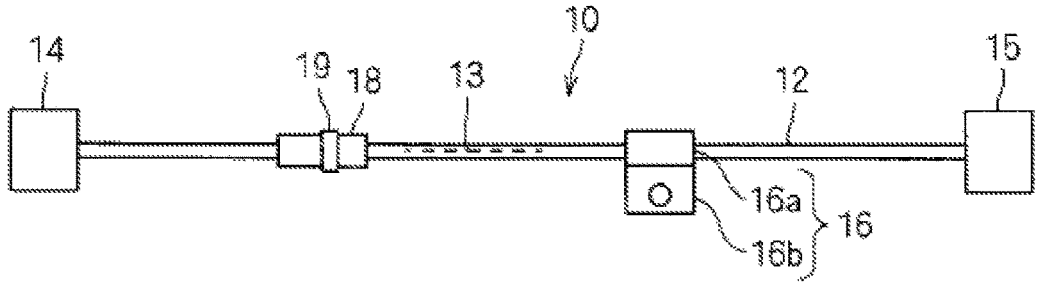
FIG. 1 is a schematic view of an exemplary wiring module to be produced.

For ease of description, a wiring module to be produced is described. FIG. 1 is a schematic view of a wiring module 10. The wiring module 10 is a component used in a vehicle as wiring that connects various electric components, and is configured by integrally assembling, onto a wire, a component connecting the wire to an electric component, a component fixating a wire to a vehicle, and the like.

In this example, the wiring module 10 includes a cable 12, connectors 14 and 15, a bracket 16, and a grommet 18.

The cable 12 is configured with a plurality of wires covered by a resin coating or the like. The connectors 14 and 15 are connected to two ends of the cable 12. The bracket 16 is mounted to a middle portion in an extension direction of the cable 12. The bracket 16 is a component obtained by press-working a metal plate or the like, and includes a cable fixation portion 16*a* and a screwing portion 16*b*. Prior to being mounted on the cable 12, the cable fixation portion 16*a* is formed in a tube shape having an open portion in an outer circumference, and in a state where the cable 12 is arranged within the cable fixation portion 16*a*, the cable fixation portion 16*a* is deformed so as to be reduced in size, and is thereby crimped and fixated to the middle portion in the extension direction of the cable fixation portion 12. The grommet 18 is a tubular member formed by an elastic member of rubber or the like, and is fitted around an exterior at the middle portion in the extension direction of the cable 12. In this state, by wrapping and fixating a wrapping band 19 around an outer circumference of the grommet 18 in a tightened state, the grommet 18 and the cable 12 are fastened tightly together. In a state where the wiring module 10 is attached to the vehicle or the like, the grommet 18 is mounted to a through-hole formed in a body of the vehicle and inhibits intrusion of water through the through-hole, inhibits the cable 12 from making direct contact with an edge of the through-hole and being damaged, and the like. An identifying mark 13 is provided to the middle portion in the extension direction of the cable 12 (here, the identifying mark 13 is provided between the bracket 16 and the grommet 18). The identifying mark 13 is formed by applying paint, or the like, and indicates a wiring location of the wiring module 10 or the like.

Figure 2:
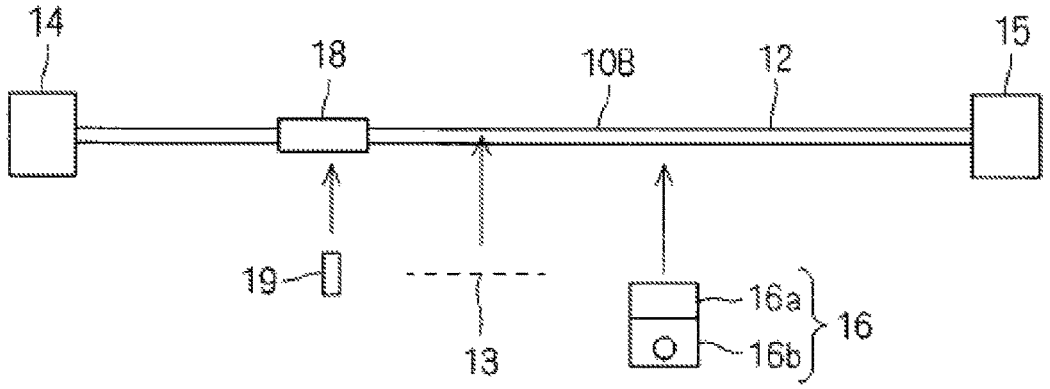
FIG. 2 illustrates exemplary work performed on the wiring module.

FIG. 2 illustrates exemplary work performed in the wiring module production plant to produce the wiring module 10. Specifically, a base wiring module 10B is supplied to the wiring module production plant, the base wiring module 10B having the grommet 18 fitted to the exterior of the cable 12 and having the connectors 14 and 15 connected to the two ends of the cable 12. Work of passing the cable 12 through the grommet 18 and work of connecting the connectors 14 and 15 to the two ends of the cable 12 (work of respectively inserting a terminal at an end portion of a wire at the two ends of the cable 12 into the connectors 14 and 15) is performed by a worker or the like prior to the base wiring module 10B being supplied to the wiring module production plant.

Work of mounting the cable fixation portion 16*a* of the bracket 16 to the middle portion in the extension direction of the cable 12, work of crimping and deforming the cable fixation portion 16*a* and fixating the cable fixation portion 16*a* to the middle portion in the extension direction of the cable 12, work of applying the identifying mark 13 to the cable 12, and work of wrapping and fixating the wrapping band 19 to the grommet 18 are performed at the wiring module production plant.

Configuration of Wiring Module Production Plant

Figure 3:
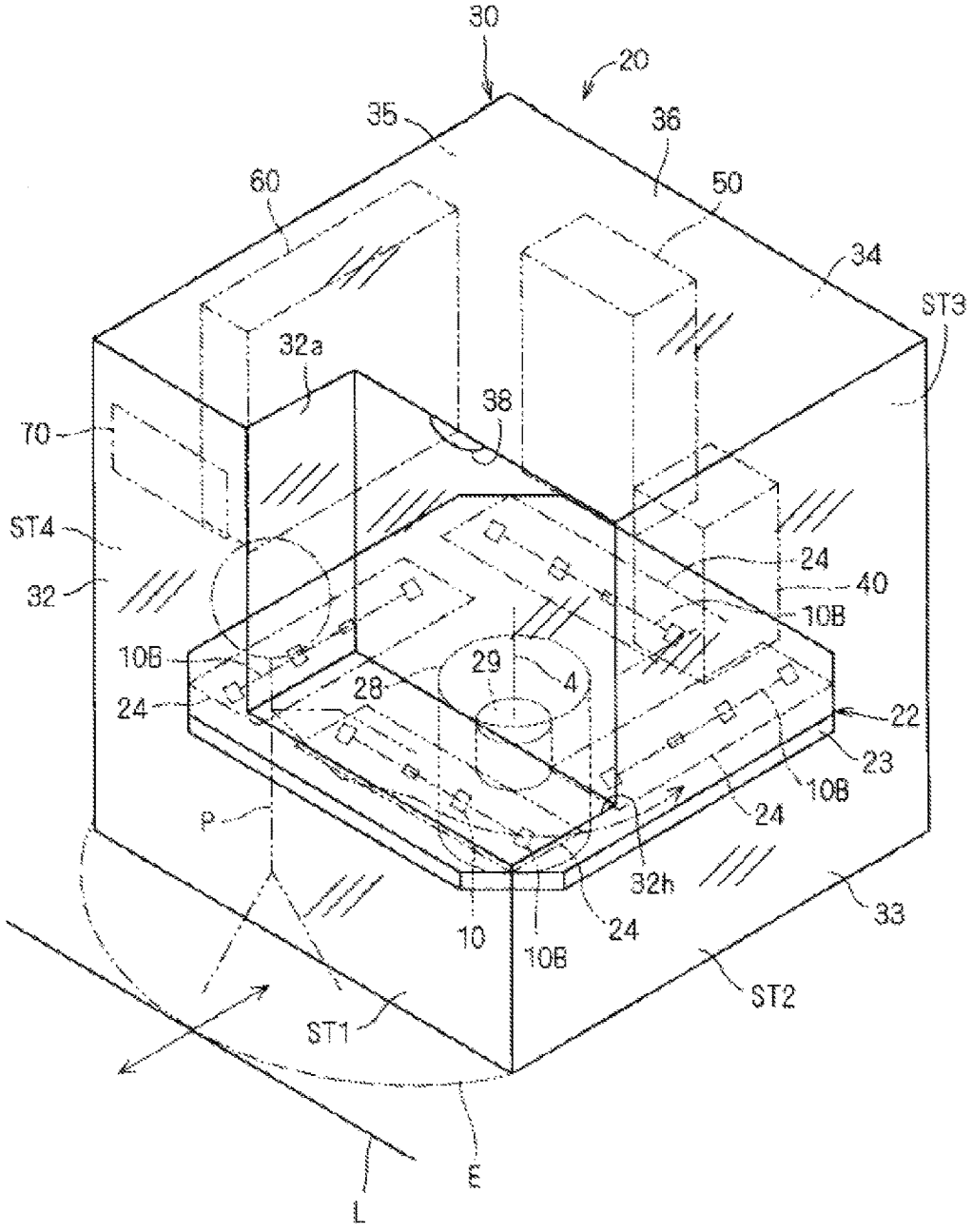
FIG. 3 is a schematic perspective view illustrating a wiring module production plant according to an embodiment.

A configuration of the wiring module production plant is described below. FIG. 3 is a schematic perspective view of a wiring module production plant 20.

The wiring module production plant 20 is a plant producing the wiring module 10 and includes a rotatable support 22.

The rotatable support 22 is supported so as to be capable of rotating. In this example, a rotation driver 28 is provided below the rotatable support 22. The rotation driver 28 includes a motor 29 capable of regulating a degree of rotation, such as a stepping motor. By transmitting a rotational drive force of the motor 29 to the rotatable support 22, the rotatable support 22 is rotationally driven at a fixed angle interval. The motor 29 can rotate the rotatable support 22, regulate rotation of the rotatable support 22, and the like, and therefore performs the role of a rotation regulator. The rotation driver 28 may also include a gear mechanism reducing a rotation speed of the motor 29, or the like, when necessary and transmitting this to the rotatable support 22.

N stages 24 (where N is an integer equal to or greater than two) are provided to the rotatable support 22. The N stages 24 are provided in N positions to be reached by N rotations, centered around a rotation axis X of the rotatable support 22. Each stage 24 is configured to allow the base wiring module 10B and the bracket 16 (objects involved in producing the wiring module 10) to be arranged thereon. In this example, an object involved in producing the wiring module 10 refers to a structural component of the wiring module 10, for example, and is a component appropriate to being supported during production of the wiring module 10. Such a component may be selected as appropriate to a shape, nature of work, and the like of the wiring module 10.

More specifically, the rotatable support 22 includes a base plate 23. The base plate 23 is formed in a square shape having diagonally clipped corners. A rotary shaft of the rotation driver 28 is coupled to a bottom portion of a center portion of the base plate 23, and the rotation driver 28 provides rotational drive, centered on the rotation axis X lying along a vertical direction (gravity direction). Four (in other words, the present embodiment is an example where N equals four) stages 24 are provided at respective positions corresponding to the four sides on a perimeter of the base plate 23. In this example, the stages 24 are provided at a position toward a first end portion on each side (position toward a right side). Therefore, the four stages 24 are provided at positions having four-fold rotational symmetry centered around the rotation axis X of the rotatable support 22. In other words, the four stages 24 are provided at positions at 90° intervals around the center. Therefore, when the rotatable support 22 is rotated at intervals of 90° (360 divided by N), each stage 24 is displaced to the respective position of the stage 24 on a downstream side in the rotation direction.

Figure 6:
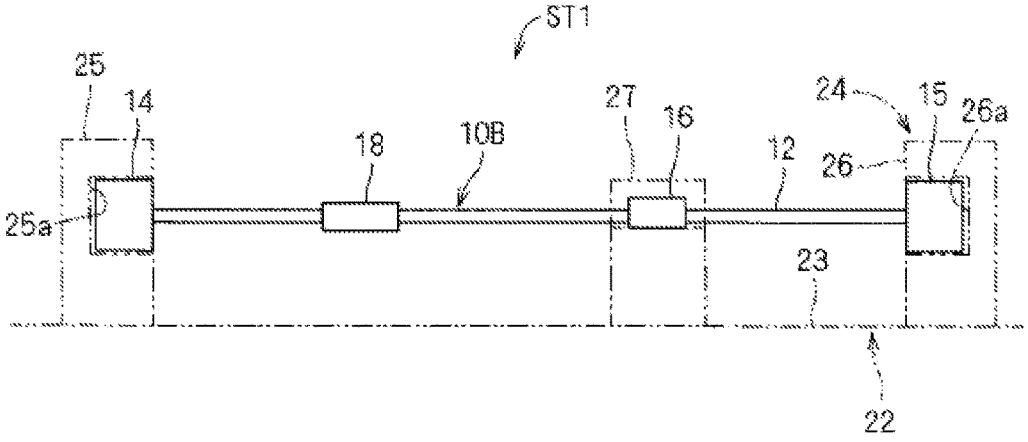
FIG. 6 is an explanatory diagram illustrating exemplary work at a manual work station.
Figure 7:
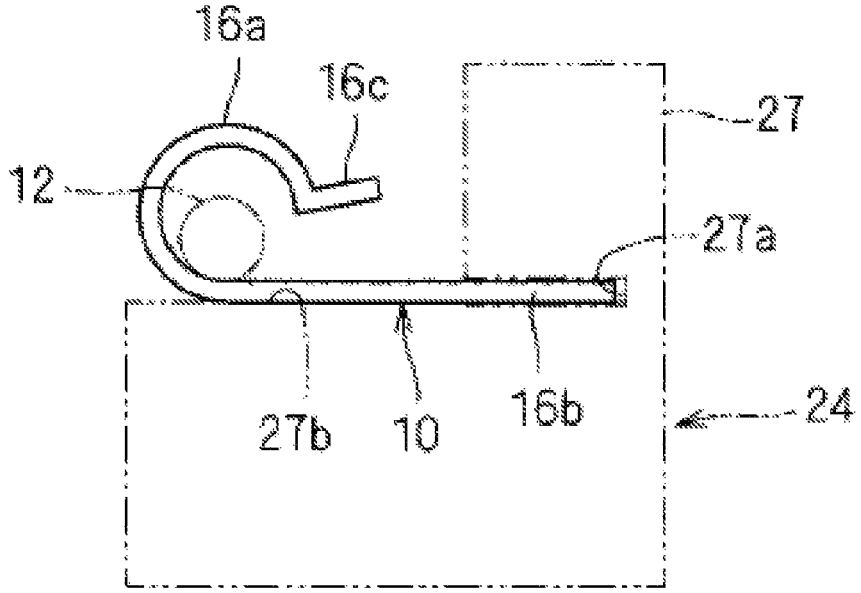
FIG. 7 is an explanatory diagram illustrating exemplary work at the manual work station.

The stage 24 is configured to allow the connectors 14 and 15 at the two ends of the base wiring module 10B and the bracket 16 temporarily attached to the cable 12 to be arranged thereon (see FIGS. 6 and 7). An exemplary configuration of such a stage 24 is described below.

N stations ST1 to ST4 are provided so as to respectively correspond to each of N positions around the wiring module production plant 20 having N-fold rotational symmetry centered around the rotation axis X of the rotatable support 22. This example treats a case where N=4, and so there are four stations ST1 to ST4.

The stations ST1 to ST4 do not rotate and are provided so as to respectively correspond to the four positions having four-fold rotational symmetry. The four stages 24 are provided to the rotatable support 22 so as to respectively correspond to the four positions having four-fold rotational symmetry. Therefore, when the rotatable support 22 is rotated at intervals of 90°, the four stages 24 can displace sequentially and cyclically relative to the four stations ST1 to ST4. Accordingly, the base wiring module 10B and bracket 16 arranged on each stage 24 can be displaced sequentially to the stations ST1 to ST4.

The stations ST1 to ST4 include a manual work station ST1 which allows manual work to be performed on the base wiring module 10B and bracket 16 (the objects), and mechanical work stations ST2 to ST4 which allow mechanical work to be performed on the base wiring module 10B and the bracket 16.

The manual work station ST1 is a station that is open to an exterior so as to allow work from outside the rotatable support 22 on the stage 24 that is deployed at a position corresponding to the manual work station ST1. The mechanical work stations ST2 to ST4 are stations provided with processing equipment 40, 50, and 60 that is capable of performing processing work on the base wiring module 10B and bracket 16 (the objects), which are arranged on the stages 24 deployed at positions corresponding to the mechanical work stations ST2 to ST4. That is, the mechanical work stations ST2 to ST4 are stations that perform processing using mechanical elements which transform energy such as electric or fluid energy from an air cylinder, hydraulic cylinder, linear motor, motor, or the like into physical movement.

Specifically, a cover 30 covering a periphery of the rotatable support 22 is provided to the periphery of the rotatable support 22. The cover 30 includes four side covers 32, 33, 34, and 35 covering four sides of the periphery of the rotatable support 22, and a top cover 36 covering the rotatable support 22 from above. The cover 30 is preferably configured by a plate capable of being transparent (for example, a transparent resin plate or the like). The side covers 32, 33, 34, and 35 and the top cover 36 are supported by a device frame encompassing the periphery of the rotatable support 22. However, the device frame is omitted from the drawings, as in FIG. 3.

Of the four side covers 32, 33, 34, and 35, a portion of the side cover 32 provided to a position corresponding to the manual work station ST1 includes a recessed portion 32*a*, which is recessed inward at a position above the stage 24 deployed at the manual work station ST1. An opening 32*h* is formed in a bottom portion of the recessed portion. This creates a state where a space above the stage 24 deployed at the manual work station ST1 is open to the exterior through the opening 32*h*. This allows a worker P standing in a space outside the stage 24 deployed at the manual work station ST1 to access the stage 24 through the opening 32*h*. The worker P performs manual work through the opening 32*h*. In this example, through the opening 32*h*, the worker P performs manual work of arranging the base wiring module 10B and the bracket 16 on the stage 24.

The manual work station ST1 further includes a human sensor 38 as a manual work end status obtainer capable of ascertaining whether the manual work at the manual work station ST1 has ended. The human sensor 38 is configured by an infrared sensor, ultrasonic distance sensor, or the like, and is configured to be capable of detecting whether any work is performed in a work area E at the manual work station ST1. In this example, the human sensor 38 is provided to a portion above the side cover 32 and above the opening 32*h*, and is configured to be capable of outputting a detection signal that corresponds to whether the worker P is present in the work area E outside the manual work station ST1. Then, when the worker P stands in the work area E and performs manual work on the stage 24 positioned at the manual work station ST1, the worker P can be detected and, utilizing that detection, a determination can be made that the manual work is in progress. Also, when the worker P ends the manual work and draws back over a retreat line L that is away from the manual work station ST1, this creates a state where the worker P is not detected and, in such a situation where the worker P is not detected, a determination can be made that the manual work has ended.

The processing equipment 40, 50, and 60 is provided to positions above the mechanical work stations ST2 to ST4 in a state supported by the device frame (not shown in the drawings). The processing equipment 40 which crimps and fixates the cable fixation portion 16*a* of the bracket 16 to the cable 12 is provided to the mechanical work station ST2. The processing equipment 50 which applies the identifying mark 13 to the cable 12 is provided to the mechanical work station ST3. The processing equipment 60 which wraps and fixates the wrapping band 19 around the cable 12 is provided to the mechanical work station ST4. The processing equipment 40, 50, and 60 include an actuator such as an air cylinder, hydraulic cylinder, or linear motor and perform the various types of processing subject to control by a controller 70 described below.

In the present embodiment, a case is described having a single manual work station ST1; however, a plurality of manual work stations may be provided instead. Also, the present embodiment describes an example in which the stations ST1 to ST4 are any of the manual work station ST1 or the mechanical work stations ST2 to ST4. However, at least one of the stations ST1 to ST4 may instead be a station where no work of any kind is performed.

The wiring module production plant 20 also includes the controller 70. In this example, the controller 70 is provided to a position toward one side of the side cover 32, which corresponds to the manual work station ST1. The controller 70 preferably includes a liquid crystal monitor, a touch screen, a switch, or the like. Through such a device, an operation status of the production plant 20 can be monitored, an operation command can be issued, and the like.

Figure 4:
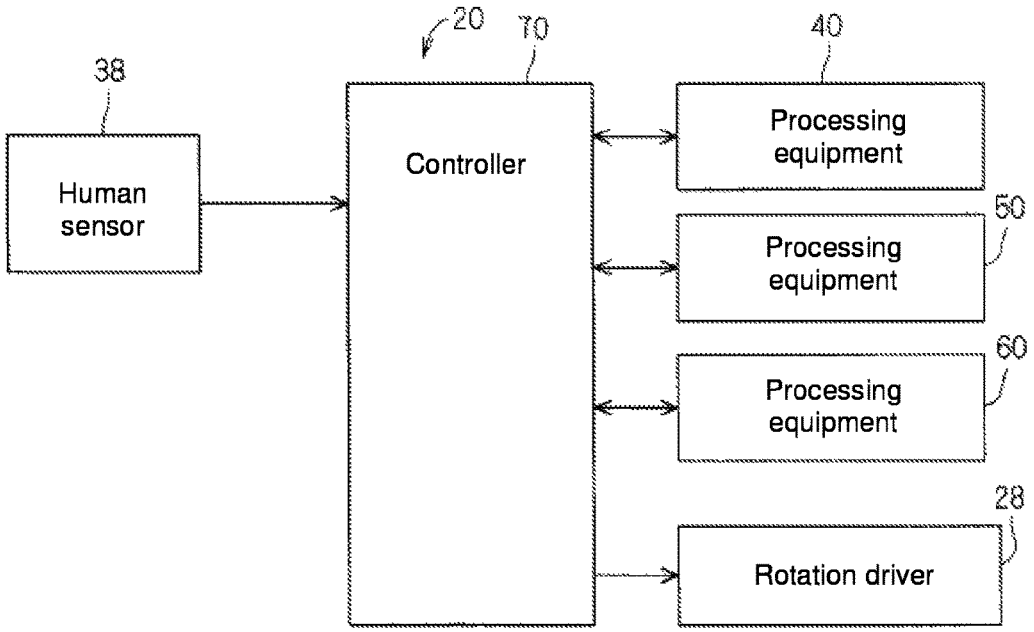
FIG. 4 is a functional block diagram illustrating an electrical configuration of the wiring module production plant.

FIG. 4 is a functional block diagram of the wiring module production plant 20. As shown in this figure, the human sensor 38 is connected to the controller 70 and a detection output of the human sensor 38 is input to the controller 70. The processing equipment 40, 50, and 60 and the rotation driver 28 are also connected to the controller 70, and the controller 70 issues various operation commands to the processing equipment 40, 50, and 60 and to the rotation driver 28. Also, a monitor signal of the processing equipment 40, 50, and 60 is provided to the controller 70 and the operation statuses of the processing equipment 40, 50, and 60 can be monitored in the controller 70. The controller 70 is configured by a computer that includes a CPU, ROM, RAM, input/output interface, and the like. Also, by performing a computation in accordance with a control program stored in the ROM, the CPU performs operation control of the processing equipment 40, 50, and 60 and the rotation driver 28 based on output from the human sensor 38 and the processing equipment 40, 50, and 60.

Figure 5:
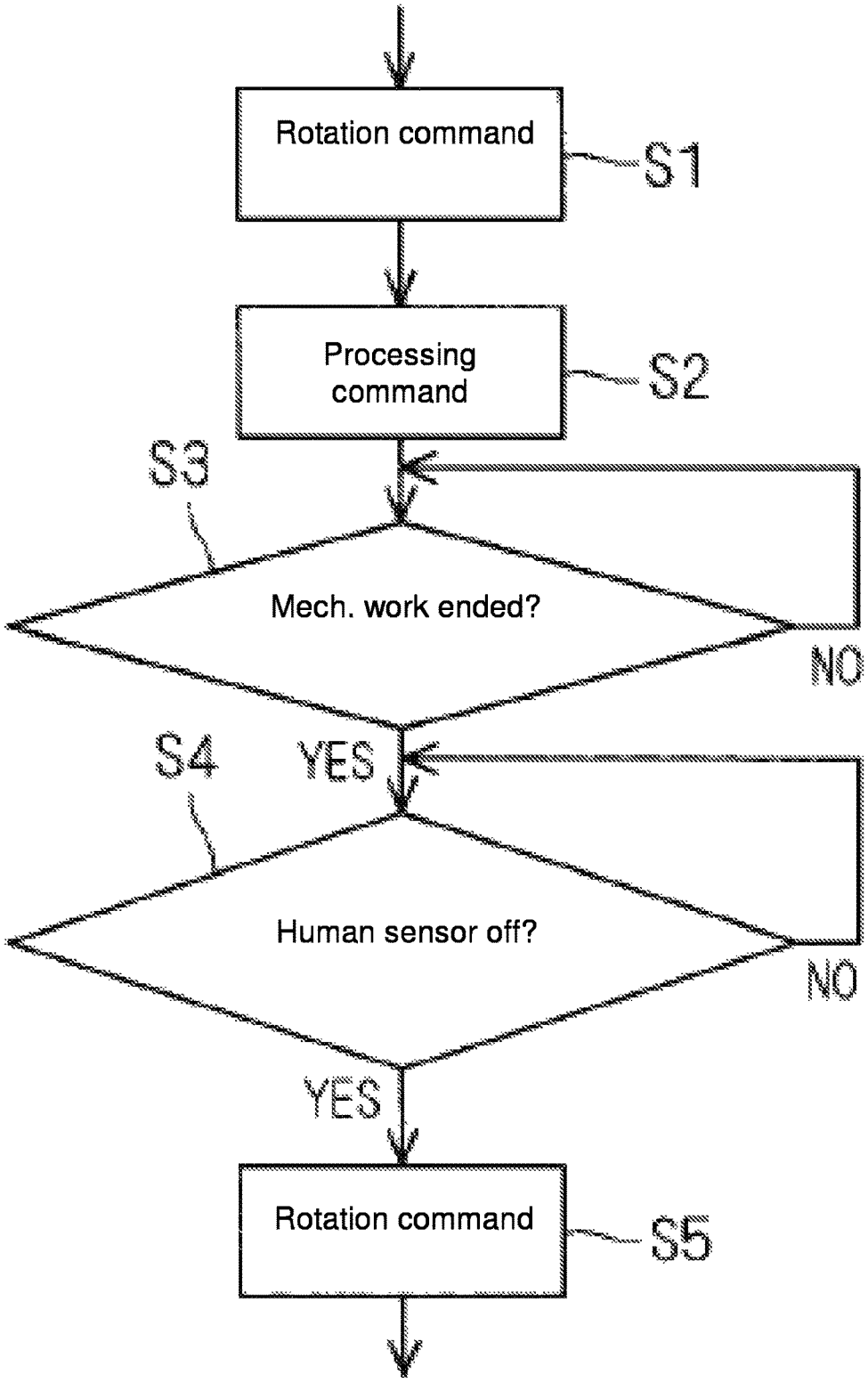
FIG. 5 is a flow chart illustrating a process of the wiring module production plant.

FIG. 5 is a flow chart illustrating a process during operation of the wiring module production plant 20. A process is imagined which begins in the midst of the base wiring module 10B and bracket 16 being arranged on each stage 24 and work being performed at each of the stations ST1 to ST4.

In step S1, a rotation command is issued to the rotation driver 28 from the controller 70. Accordingly, the rotation driver 28 rotates the rotatable support 22 in a predetermined direction (direction in which the stage 24 at the station ST1 displaces to the station ST2) by 360/N degrees (i.e., 90°). When rotated, the stages 24 deployed at each of the stations ST1, ST2, ST3, and ST4 displace to the next station ST2, ST3, ST4, and ST1, respectively.

After this, in step S2, the controller 70 issues a processing command to each piece of processing equipment 40, 50, and 60. Accordingly, mechanical processing is performed by each piece of processing equipment 40, 50, and 60 at the mechanical work stations ST2 to ST4. At this point, the worker P performs manual work at the manual work station ST1.

After this, in step S3, a determination is made as to whether the mechanical work has ended. In a case where a portion processed by each piece of processing equipment 40, 50, and 60 returns to its original position, for example, this determination can be made by configuring the processing equipment 40, 50, and 60 to provide a signal to that effect to the controller 70, and the controller 70 monitoring whether the signals have been received from each piece of processing equipment 40, 50, and 60 that the processed portion has returned to its original position. In other words, in a case where each portion processed by the processing equipment 40, 50, and 60 have returned to their original positions, a configuration in which the processing equipment 40, 50, and 60 output a signal to that effect can perform the role of a mechanical work end status obtainer capable of ascertaining whether the mechanical work at the mechanical work stations ST2 to ST4 has ended. In step S3, when the mechanical work is determined not to have ended, the process of step S3 is repeated, and when the mechanical work is determined to have ended, the process advances to the next step: step S4.

In step S4, the controller 70 determines whether the human sensor 38 is off based on output from the human sensor 38. When the human sensor 38 is determined to be off, the rotatable support 22 is controlled so as to be capable of rotation. In this example, the motor 29 is driven so as to rotate the rotatable support 22 by 90°. In step S4, when the manual work is determined not to have ended, the process of step S4 is repeated, and when the manual work is determined to have ended, the process advances to the next step: step S5.

The processes of steps S3 and S4 are, overall, a process determining whether work at the manual work station ST1 and the mechanical work stations ST2 to ST4 has ended. Therefore, the process of step S3 and the process of step S4 may also be performed in the opposite order.

In step S5, the controller 70 issues a command to the rotation driver 28 to rotate the rotatable support 22. Accordingly, the rotatable support 22 rotates 90°, and each stage 24 displaces to the next station ST1 to ST4.

By repeating the process described above, each of the stages 24 are displaced sequentially and cyclically to the stations ST1 to ST4.

Operation of Wiring Module Production Plant

Operation of the wiring module production plant 20 described above is described in conjunction with manual work performed by the worker P. The description that follows focuses on one of the four stages 24, but similar work is also carried out at the other stages 24 in sequence.

Figure 8:
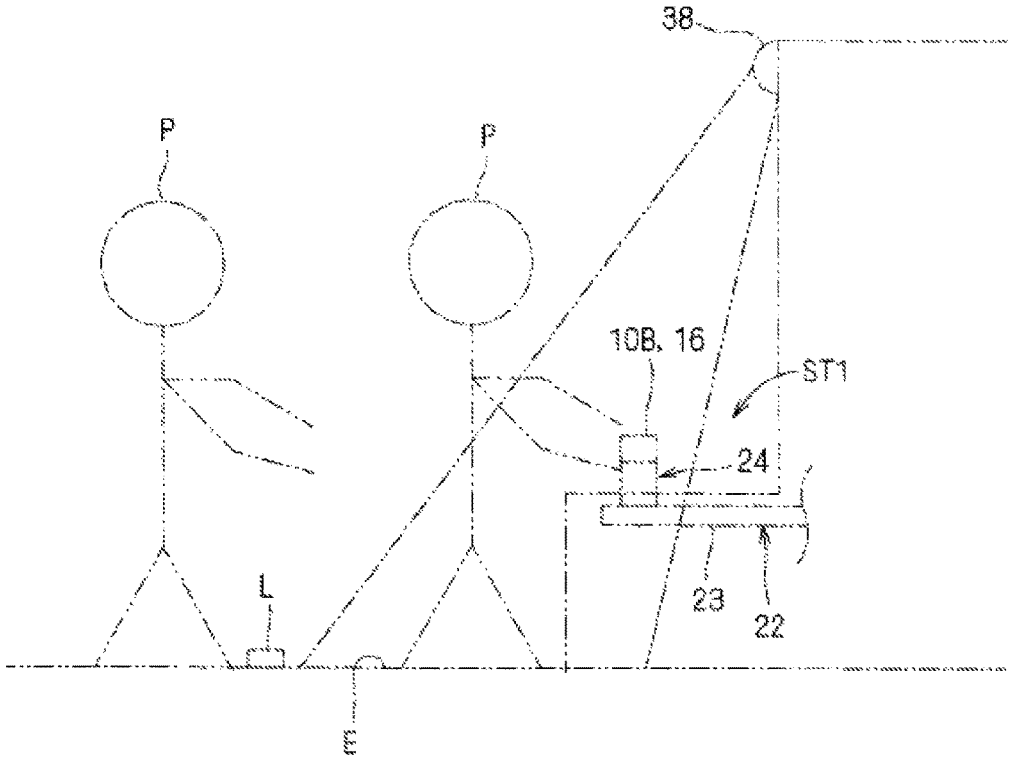
FIG. 8 is an explanatory diagram illustrating exemplary work at the manual work station.

First, as shown in FIGS. 6 to 8, the worker P arranges the base wiring module 10B and the bracket 16 on the stage 24 at the manual work station ST1. The stage 24 includes connector stages 25 and 26 on which the connectors 14 and 15, respectively, at the two ends of the base wiring module 10B can be arranged; and a bracket stage 27 on which the bracket 16 can be arranged.

The connector stages 25 and 26 stand upright from the base plate 23 at positions separated by a length dimension of the base wiring module 10B. Each of the connector stages 25 and 26 include a depression 25*a* and 26*a*, respectively, which allows the connectors 14 and 15 to be inserted in a posture facing each other. The worker P arranges the connectors 14 and 15 on the corresponding connector stages 25 and 26, and thereby the base wiring module 10B is supported in a state where the cable 12 bridges the space between the connector stages 25 and 26. The bracket stage 27 stands upright from the base plate 23 at a position between the connector stages 25 and 26.

The bracket stage 27 is configured to allow the bracket 16 to be arranged thereon in a state where the middle portion in the extension direction of the cable 12 is arranged within the cable fixation portion 16*a* of the bracket 16. The bracket stage 27 includes a depression 27*a* into which a leading edge portion of the screwing portion 16*b* of the bracket 16 can be inserted; and a placement surface 27*b* capable of supporting in a horizontal posture a base end of the screwing portion 16*b* and a portion of the cable fixation portion 16*a* continuous with the screwing portion 16*b*. In a state where the leading edge portion of the screwing portion 16*b* is inserted into the depression 27*a*, and also where the base end portion of the screwing portion 16*b* and the portion of the cable fixation portion 16*a* continuous with the screwing portion 16*b* are supported on the placement surface 27*b*, a space is created above the cable fixation portion 16*a*.

When the worker P arranges the base wiring module 10B and the bracket 16 on the stage 24 at the manual work station ST1, the worker P occupies the work area E in a position in front of the stage 24. Therefore, the presence of the worker P is detected by the human sensor 38 (see FIG. 8). When the worker P ends the work and moves rearward from the work area E, the human sensor 38 detects that the worker P is not present in the work area E. Accordingly, based on the output from the human sensor 38, the controller 70 determines that the worker P is not present in the work area E, i.e., that the manual work has ended.

When the worker P is performing the manual work at the manual work station ST1, the processing equipment 40, 50, and 60 is performing the mechanical work on the base wiring module 10B and bracket 16 arranged on the stages 24 deployed at each of the mechanical work stations ST2 to ST4. Then, when the mechanical work by the processing equipment 40, 50, and 60 and the manual work have ended, the rotatable support 22 is driven by the motor 29 of the rotation driver 28 and rotates 90°. Accordingly, each stage 24 displaces to the next station ST1 to ST4.

Figure 9:
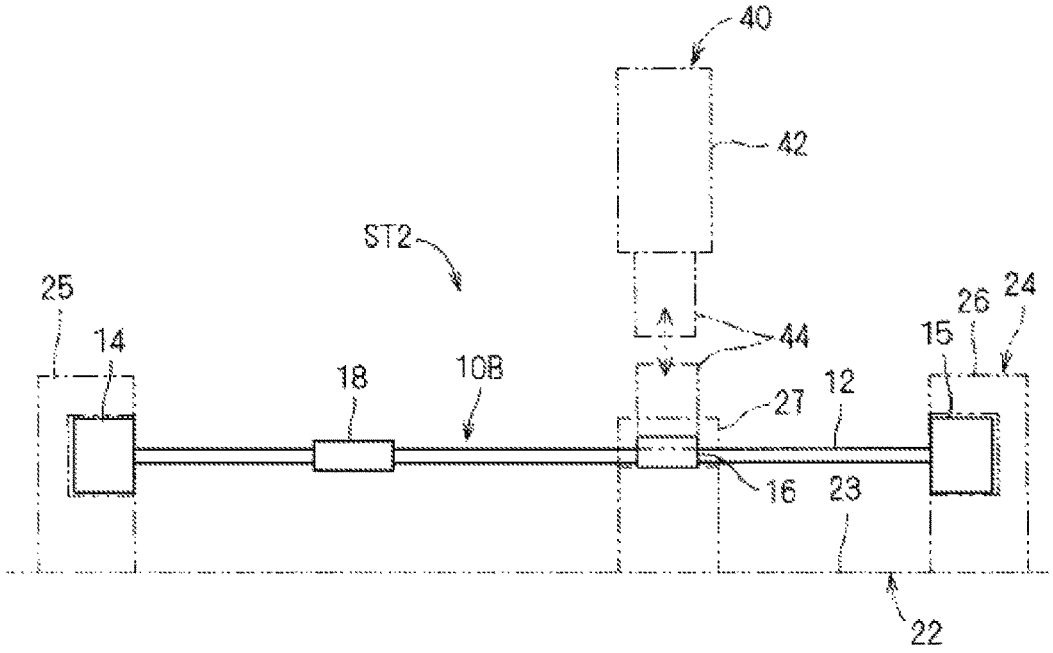
FIG. 9 is an explanatory diagram illustrating exemplary work at a mechanical work station.
Figure 10:
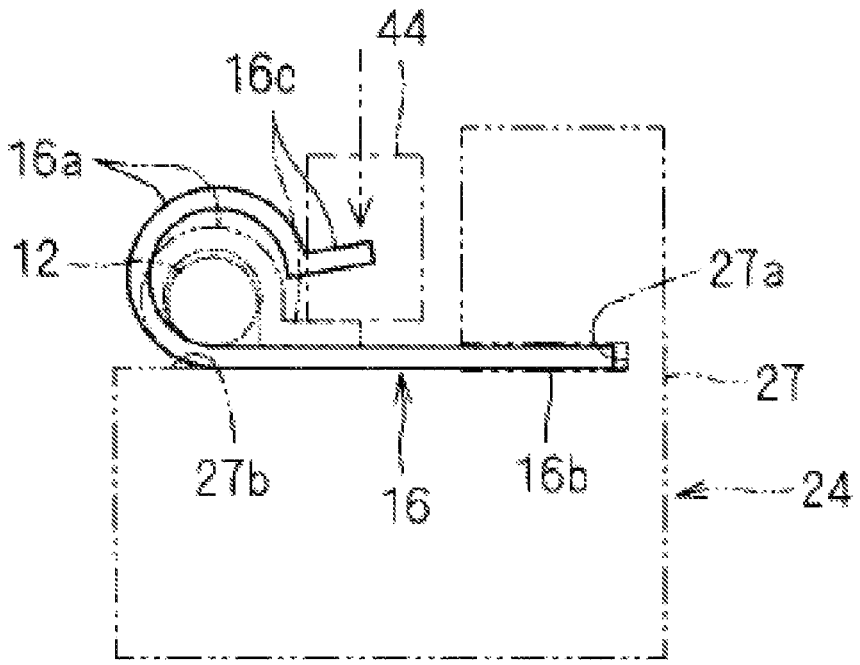
FIG. 10 is an explanatory diagram illustrating exemplary work at the mechanical work station.

As shown in FIGS. 9 and 10, the processing equipment 40, which crimps and fixates the cable fixation portion 16*a* of the bracket 16 onto the cable 12, is provided to the mechanical work station ST2. The processing equipment 40 includes, for example, an elevation driver 42 capable of driving a lifting or lowering operation, such as an air cylinder, hydraulic cylinder, or linear motor; and a crimper 44 capable of rising and lowering with respect to the bracket stage 27 due to the elevation driver 42.

Then, in a state where any one of the stages 24 is deployed below the processing equipment 40, the crimper 44 is driven by the elevation driver 42 and lowers toward the bracket stage 27. When this occurs, the crimper 44 displaces toward the placement surface 27*b* of the bracket stage 27 and presses an end piece 16*c* of the cable fixation portion 16*a* toward the screwing portion 16*b*. Accordingly, the cable fixation portion 16*a* is deformed and crimped inward, and the middle portion in the extension direction of the cable 12 is fixated within the cable fixation portion 16*a*. After this, the crimper 44 is driven by the elevation driver 42 to rise, and when the crimper 44 returns to its original position, a position detection sensor or the like detects the return of the crimper 44 and outputs a signal that the mechanical work of the processing equipment 40 has ended, which is provided to the controller 70.

Then, when the mechanical work by the processing equipment 40, 50, and 60 and the manual work have ended, the rotatable support 22 is driven by the motor 29 of the rotation driver 28 and rotates 90°, and each of the stages 24 displaces to the next station ST1 to ST4.

Figure 11:
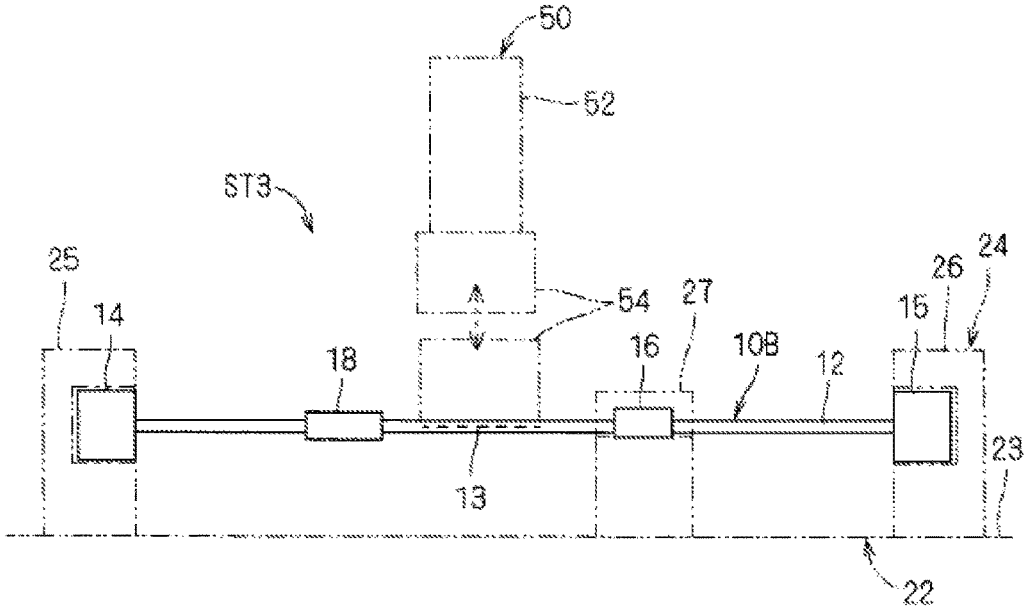
FIG. 11 is an explanatory diagram illustrating exemplary work at a different mechanical work station.

As shown in FIG. 11, the processing equipment 50, which applies the identifying mark 13 to the cable 12, is provided to the mechanical work station ST3. The processing equipment 50 includes, for example, an elevation driver 52 capable of driving a lifting or lowering operation, such as an air cylinder, hydraulic cylinder, or linear motor; and a mark applicator 54 capable of rising and lowering with respect to the cable 12 due to the elevation driver 52. The mark applicator 54 includes, for example, an absorption body such as a sponge which has soaked up ink, a configuration capable of emitting a jet of ink, or the like.

Then, in a state where any one of the stages 24 is deployed below the processing equipment 50, the mark applicator 54 is driven by the elevation driver 52 and lowers toward an upward-facing surface portion on the middle portion in the extension direction of the cable 12. Then, the identifying mark 13 is applied to the middle portion in the extension direction of the cable 12 by painting or the like on the upward-facing surface portion on the middle portion in the extension direction of the cable 12 by the mark applicator 54. After this, the mark applicator 54 is driven by the elevation driver 52 to rise, and when the mark applicator 54 returns to its original position, a position detection sensor or the like detects the return of the mark applicator 54 and outputs a signal that the mechanical work of the processing equipment 50 has ended, which is provided to the controller 70.

Then, when the mechanical work by the processing equipment 40, 50, and 60 and the manual work have ended, the rotatable support 22 is driven by the motor 29 of the rotation driver 28 and rotates 90°, and each of the stages 24 displaces to the next station ST1 to ST4.

Figure 12:
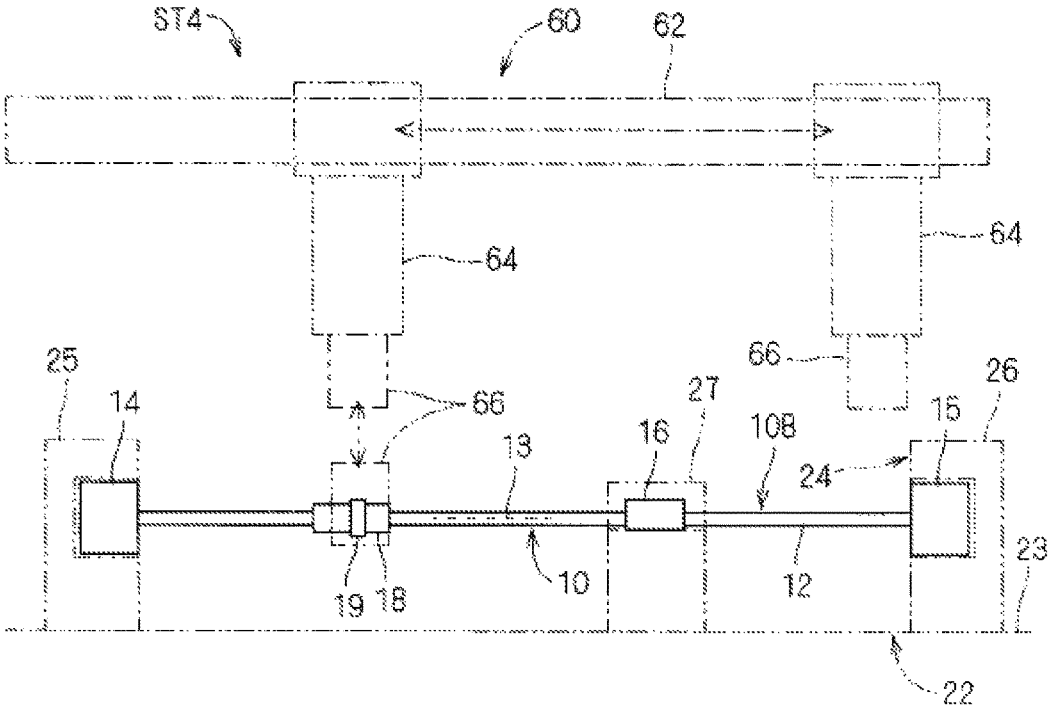
FIG. 12 is an explanatory diagram illustrating exemplary work at yet another different mechanical work station.

As shown in FIG. 12, the processing equipment 60, which wraps the wrapping band 19 around the grommet 18, is provided to the mechanical work station ST4. The processing equipment 60 includes, for example, a horizontal driver 62, an elevation driver 64, and a band wrapping mechanism 66 capable of wrapping the wrapping band 19. The horizontal driver 62 and the elevation driver 64 are each configured by an air cylinder, hydraulic cylinder, linear motor, or the like. The horizontal driver 62 displaces the elevation driver 64 above the base wiring module 10B, which is arranged on the stage 24, and along an extension direction thereof. The elevation driver 64 raises and lowers the band wrapping mechanism 66. The band wrapping mechanism 66 is configured to be capable of wrapping a continuously supplied band made of resin around the cable 12. Such a band wrapping mechanism 66 can employ a configuration generally known for a band binding device, or the like.

In a default state, the elevation driver 64 is in standby at a position temporarily closer to the horizontal driver 62 as the original position. Then, in a state where any one of the stages 24 is deployed below the processing equipment 60, the elevation driver 64 is driven by the horizontal driver 62 and displaces to a position above the grommet 18. After this, the band wrapping mechanism 66 is driven by the elevation driver 64 and displaces toward the grommet 18, after which the band wrapping mechanism 66 wraps the wrapping band 19 around the grommet 18. After this, the band wrapping mechanism 66 is driven by the elevation driver 64 to rise, and when the elevation driver 64 is driven horizontally by the horizontal driver 62 and returns to its original position, a position detection sensor or the like detects the return of the elevation driver 64 and outputs a signal that the mechanical work of the processing equipment 60 has ended, which is provided to the controller 70.

Then, when the mechanical work by the processing equipment 40, 50, and 60 and the manual work have ended, the rotatable support 22 is driven by the motor 29 of the rotation driver 28 and rotates 90°, and each of the stages 24 displaces to the next station ST1 to ST4.

The stage 24 which returns to the station ST1 has the completed wiring module 10 arranged thereon. After the worker P removes the completed wiring module 10 from the stage 24, the worker P performs the work of arranging the base wiring module 10B and the bracket 16 on the stage 24, as described above. In other words, the work of removing the wiring module 10 and of arranging the base wiring module 10B and bracket 16 is performed at the manual work station ST1.

With the wiring module production plant 20 configured as described above, when the rotatable support 22 is rotated in a state where objects are arranged on each of the N (in this example, N=4) stages 24, the base wiring module 10B and bracket 16 (the objects) arranged on each of the N stages 24 can be transported to each of the N stations ST1 to ST4 in sequence. Manual work can be performed on the base wiring module 10B and bracket 16 at the manual work station ST1, and mechanical work can be performed on the base wiring module 10B and the bracket 16 at the mechanical work stations ST2 to ST4. Therefore, work performed manually is combined with mechanical work and the wiring module 10 can be manufactured efficiently.

Also, at the manual work station ST1, the stage 24 is open to the exterior through the opening 32*h*. Therefore, the worker P can readily perform work (in this example, the work of arranging and the work of removing) on the base wiring module 10B and bracket 16 (the objects).

At the mechanical work stations ST2 to ST4, the processing equipment 40, 50, and 60 can readily perform mechanical work on the base wiring module 10B and the bracket 16.

Also, when the work at the manual work station ST1 and the mechanical work stations ST2 to ST4 is determined to have ended, the rotatable support 22 becomes rotatable. Therefore, a situation can be prevented in which the rotatable support 22 rotates and the stages 24 displace during work, and the work can be readily performed.

In addition, the rotatable support 22 is driven to rotate by the motor 29 of the rotation driver 28, and therefore sequential work can be performed smoothly.

However, the rotatable support 22 is not necessarily driven to rotate by the motor 29 and may instead be manually rotated by the worker. In such a case, preferably, a brake mechanism is provided to a support shaft rotatably supporting the rotatable support 22, the brake mechanism regulating the rotation of the rotatable support 22. During work at the manual work station ST1 and the mechanical work stations ST2 to ST4, the rotation of the rotatable support 22 is halted by the brake mechanism and, after each task has ended, the halt on rotation is released and rotation is enabled.

Also, the determination that the manual work at the manual work station ST1 has ended is based on the output of the human sensor 38. Therefore, when the worker P leaves the work area E, a determination that the manual work at the manual work station ST1 has ended is made automatically, and therefore there is no burden on the worker P and the determination that the manual work has ended can be made more reliably.

In addition, the end of the manual work at the manual work station ST1 may be ascertained by providing an operable switch nearby and allowing the worker P to operate the switch.

Modifications

Given the embodiment described above, various modifications are now discussed.

First, the work performed at the manual work station ST1 and the mechanical work stations ST2 to ST4 is not limited to the examples given above.

For example, work such as attaching a sheathing member such as a corrugated tube or protector may be performed at the manual work station ST1. Also, work such as wrapping an adhesive tape may be performed at the mechanical work stations ST2 to ST4, for example. Also, contacts capable of making contact with terminals of the connectors 14 and 15 arranged on the connector stages 25 and 26 may be provided, and a conductivity test may be performed at any of the stations ST1 to ST4.

The number of manual work stations and mechanical work stations is defined as appropriate to a number of tasks appropriate for the manual work and the number of tasks appropriate for the mechanical work.

In addition, in the embodiment described above, a case is described where N is four (i.e., an example where four stages 24 and four stations ST1 to ST4 are provided). However, N may be any integer of two or more.

Figure 13:
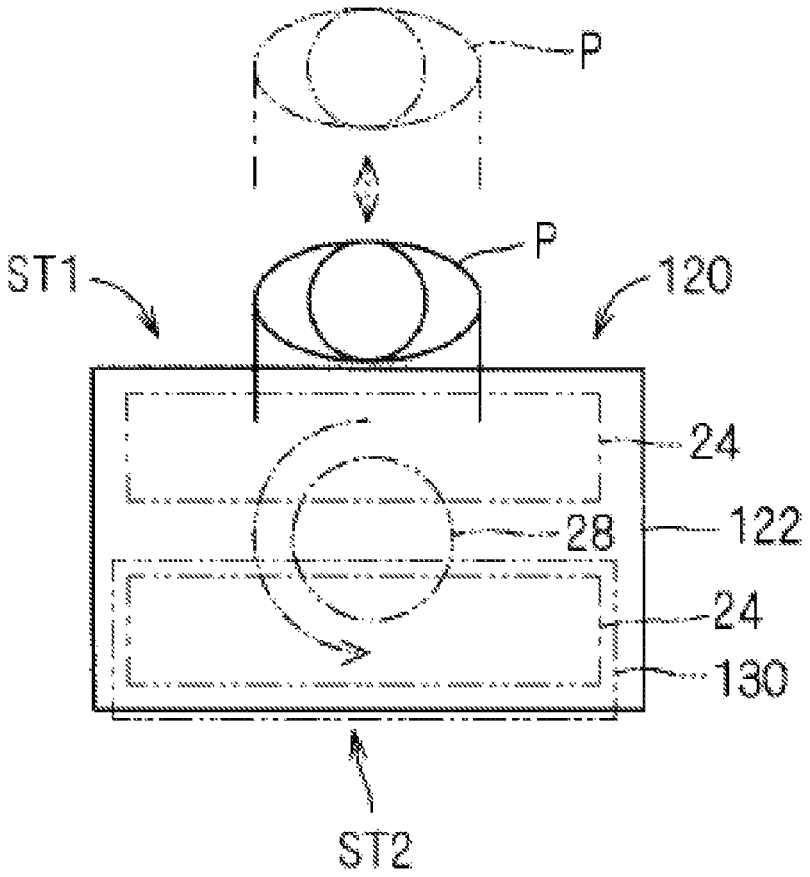
FIG. 13 is a schematic plan view illustrating a wiring module production plant according to a modification.

FIG. 13 is a schematic plan view of a wiring module production plant 120 in a case where N is two.

In this example, two stages 24 which face each other are provided to a rotatable support 122 (corresponding to the rotatable support 22), and the rotation driver 28 is provided between the stages 24. One manual work station ST1 and one mechanical work station ST2 are provided around the rotation axis of the rotatable support 122. Processing equipment 130 is provided to the mechanical work station ST2. The rotation driver 28 rotates the rotatable support 122 in units of 180°. Therefore, the two stages 24 displace sequentially through the single manual work station ST1 and the single mechanical work station ST2. Accordingly, manual work can be performed on an object at the manual work station ST1 and mechanical work can be performed on the object at the mechanical work station ST2, achieving an operational effect similar to that of the above-described embodiment.

Figure 14:
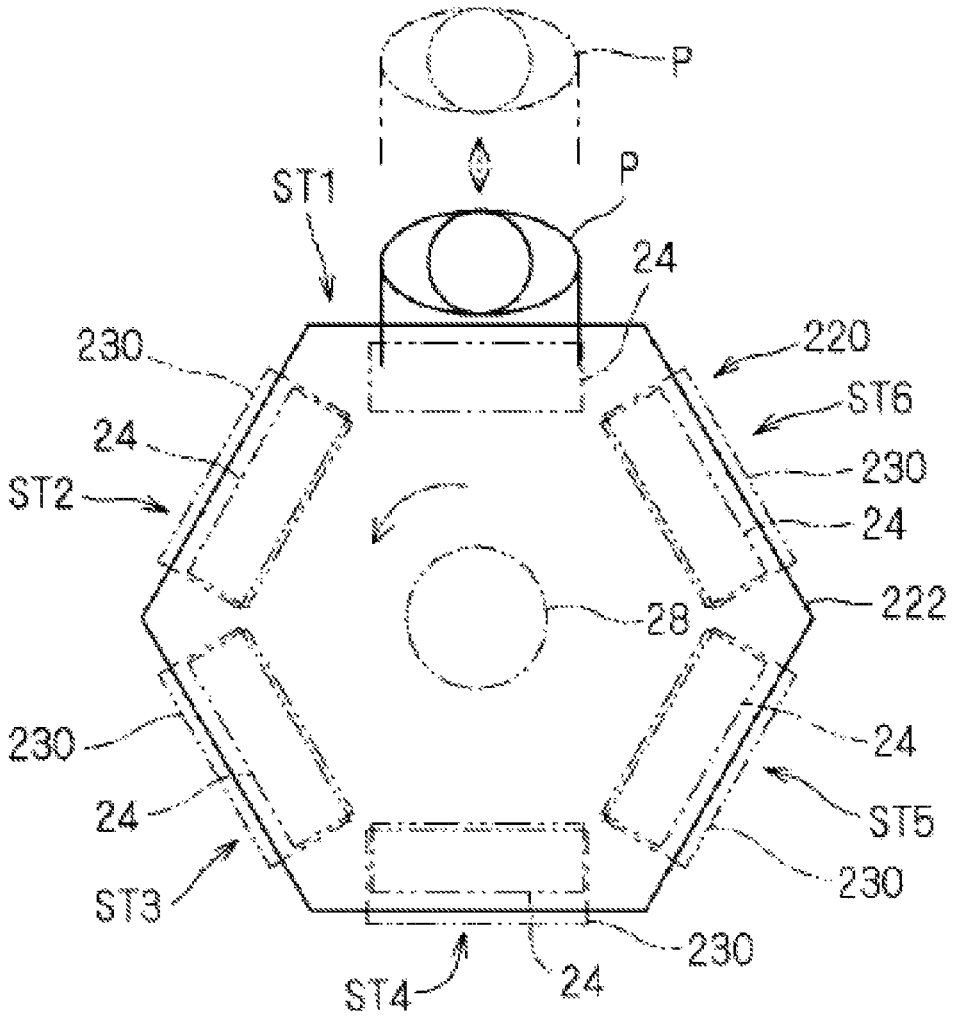
FIG. 14 is a schematic plan view illustrating a wiring module production plant according to another modification.

FIG. 14 is a schematic plan view of a wiring module production plant 220 in a case where N is six.

In this example, a total of six stages 24 are provided to a rotatable support 222 (corresponding to the rotatable support 22) at six positions having six-fold rotational symmetry centered around a rotation axis of the rotatable support 222. The rotation driver 28 is provided at the center of the rotatable support 222. The manual work station ST1 is provided at one of the six positions having six-fold rotational symmetry centered around the rotation axis of the rotatable support 222, and a total of five mechanical work stations ST2 to ST6 are provided to each of the remaining five positions. Processing equipment 230 is provided to each of the mechanical work stations ST2 to ST6. The processing equipment 230 provided to the mechanical work stations ST2 to ST6 is typically equipment performing different mechanical work. The rotation driver 28 rotates the rotatable support 222 in units of 60° (360° divided by six). Therefore, the six stages 24 displace sequentially through the single manual work station ST1 and the five mechanical work stations ST2 to ST6. Accordingly, manual work can be performed on an object at the manual work station ST1 and mechanical work can be performed on the object at the mechanical work stations ST2 to ST6, achieving an operational effect similar to that of the above-described embodiment.

The configurations described in the above embodiment and modifications can be combined as appropriate so long as they do not contradict each other.

In the above, the present invention is described in detail. However, the above description is, in all aspects, for exemplary purposes and the present invention is not limited by the description. Numerous modifications not given as examples are understood to be conceivable without departing from the scope of the present invention.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

What is claimed is:

1. A wiring module production plant producing a wiring module, the production plant comprising:

a rotatable support supported so as to be capable of rotating and having N stages (where N is an integer equal to or greater than two) on which an object involved in production of the wiring module can be arranged, the stages corresponding to each of N positions having N-fold rotational symmetry; and N stations respectively corresponding to each of the N positions having N-fold rotational symmetry centered around a rotation axis of the rotatable support, the N stations including a manual work station configured to allow manual work to be performed on the object, and a mechanical work station configured to allow mechanical work to be performed on the object.

2. The wiring module production plant according to claim 1, wherein the manual work station is open to an exterior so as to allow work from outside the rotatable support on the stage that is deployed at a position corresponding to the manual work station.

3. The wiring module production plant according to claim 1, wherein the mechanical work station is provided with processing equipment that is configured to perform processing work on the object arranged on the stage that is deployed at a position corresponding to the mechanical work station.

4. The wiring module production plant according to claim 1, further comprising:

a rotation regulator configured to regulate rotation of the rotatable support;

a manual work end status obtainer capable of ascertaining whether manual work at the manual work station has ended;

a mechanical work end status obtainer capable of ascertaining whether mechanical work at the mechanical work station has ended; and a controller controlling the rotation regulator such that, when a determination is made, based on an output result of the manual work end status obtainer and the mechanical work end status obtainer, that work at the manual work station and the mechanical work station has ended, rotation of the rotatable support is enabled.

5. The wiring module production plant according to claim 4, wherein the rotation regulator is a motor rotating the rotatable support, and the controller controls drive of the motor such that, when a determination is made that work at the manual work station and the mechanical work station has ended, the rotatable support is rotated.

6. The wiring module production plant according to claim 4, wherein the manual work end status obtainer includes a human sensor detecting whether a worker is present in a work area of the manual work station.

* * * * *